United States Patent [19]

Miskolczy et al.

[11] 4,160,641

[45] Jul. 10, 1979

[54] CONTINUOUS FURNACE

[75] Inventors: Gabor Miskolczy, Carlisle, Mass.; Leonard G. Nowak, Ypsilanti; Paul K. Shefsiek, Farmington, both of Mich.

[73] Assignee: Holcroft & Company, Livonia, Mich.

[21] Appl. No.: 888,714

[22] Filed: Mar. 21, 1978

[30] Foreign Application Priority Data

Sep. 15, 1977 [CA] Canada ..... 286780

[51] Int. Cl.[2] ..... F27B 9/28

[52] U.S. Cl. ..... 432/59; 266/103; 431/190; 432/130

[58] Field of Search ..... 266/102, 103; 431/190; 432/8, 59, 130, 146

[56] References Cited

U.S. PATENT DOCUMENTS

| | | | |
|---|---|---|---|
| 2,018,956 | 10/1935 | Hepburn et al. | 432/146 |
| 2,625,387 | 1/1953 | Hess | 432/8 |
| 2,988,350 | 6/1961 | Munford | 432/146 |
| 2,998,966 | 9/1961 | Knight | 432/42 |
| 3,837,794 | 9/1974 | Phillips | 432/8 |

*Primary Examiner*—John J. Camby

*Attorney, Agent, or Firm*—James L. Neal; Herbert E. Messenger

[57] ABSTRACT

A furnace for receiving continuously advancing stock in linear array is assembled from a number of independent furnace units. In each unit, a furnace chamber surrounds the advancing stock with a radiative wall. Each chamber is fired by gas burners which surround the stock at the chamber exit. The burners include a series of gas jets which feed the fuel, with or without air, radially into the chamber toward the stock and a series of air jets which are paired with the gas jets to feed combustion air axially into the chamber.

13 Claims, 4 Drawing Figures

CONTINUOUS FURNACE

BACKGROUND OF THE INVENTION

The invention relates to apparatus for heating stock which travels linearly through an elongated furnace chamber surrounding the path of travel. One problem encountered in such furnaces is achieving a uniform circle of heat energy around the path of travel to heat the stock rapidly on all sides and provide even temperature distribution therearound.

It is accordingly an object of this invention to provide a furnace wherein combustion encircles a path along which stock travels to provide uniform heat distribution therearound.

A further object of the invention is to provide a furnace having an elongated combustion zone through which stock travels axially and which has a heat radiating surface encircling the axial path.

It is also an object of the invention to provide a plurality of like furnace modules which may be operatively connected in series.

DETAILED DESCRIPTION OF THE DRAWINGS

Figure 1:
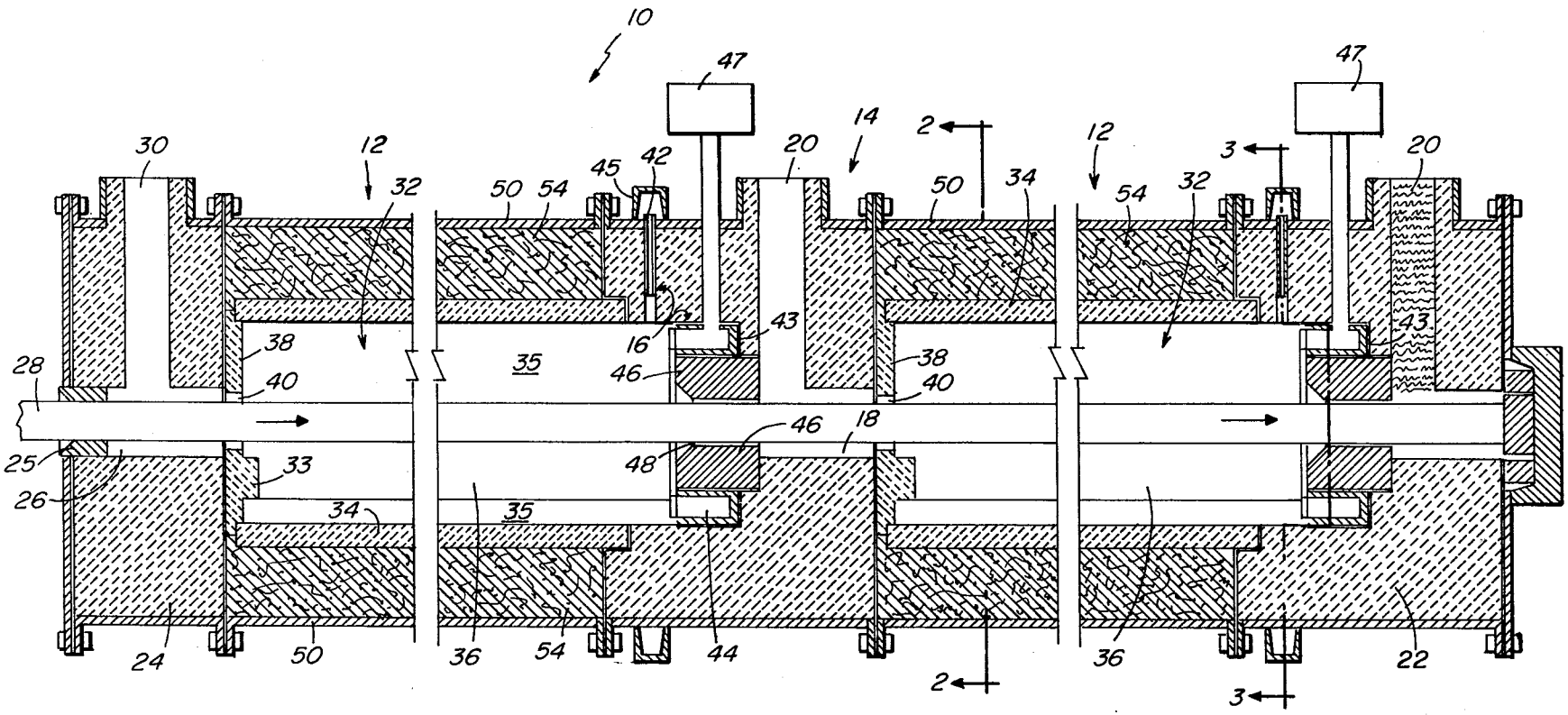
FIG. 1 is a sectional view illustrating a bar or billet heater constructed in accordance with the present invention.

In reference to FIG. 1, there is shown a continuous bar or billet heating furnace 10 comprising two individual modules or units 12. Interconnecting the two furnace modules 12 is a transitional section 14 incorporating a burner means 16, a stock delivery channel 18 and a flue means 20. The end of the furnace is formed by a final transitional section 22 almost identical to the transitional section 14. The only difference between the two sections is that the flue means 20 is blocked in section 22. The entrance to the furnace is formed by an initial transitional section 24, which provides a delivery channel 26 for the stock 28, a flame sealing annulus 25 and a flue means 30. Furnaces may be constructed with any number of furnace modules, depending upon the requirements of the individual application.

Figure 2:
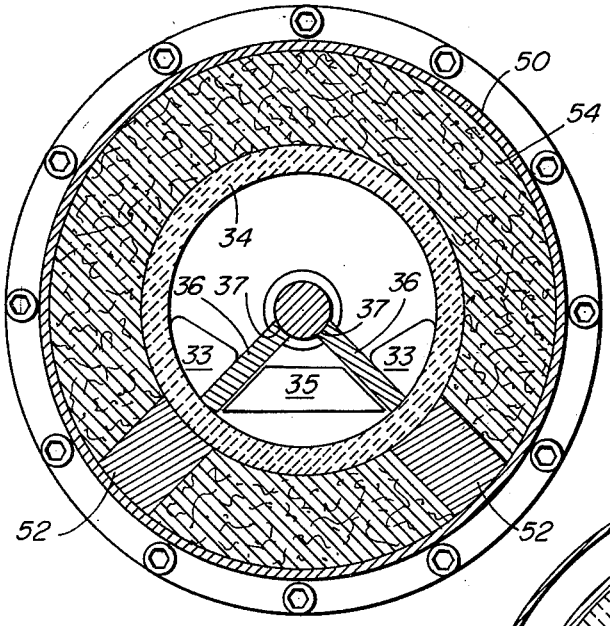
FIG. 2 is a sectional view of the device of FIG. 1, taken along the lines 2—2.

Each furnace module 12 has a cylindrical furnace chamber 32 formed by a refractory liner 34. The liner 34 is suspended within an outer steel case 50 by a pair of support blocks 52, shown in FIG. 2, which are preferably formed of structural insulating material. Open space between the liner 34 and the steel case 50 is filled with thermal insulating material 54. The material forming the liner 34 preferably forms a reradiating surface 35 from which heat energy incident thereon is radiated back to the chamber 32. The radiative efficiency of the surface is therefore an important factor in determining the overall furnace efficiency. Ideally, the surface of the liner 34 would function adiabatically to reflect or radiate all heat incident thereon to the chamber 32. The liner 34 may be of various suitable materials, such as refractory firebrick and other ceramics. At the longitudinal axis of the cylindrical liner 34, a central path is defined along which the stock 28 is supported by a pair of skid rails 36. As shown in FIG. 2, the skid rails 36 are solid plates having a generally rectangular cross-sectional configuration which form along the edge 37 thereof a surface for supporting the stock and permitting movement of the stock therealong. The rails 36 are supported upon the refractory liner 34 and rest over the supporting blocks 52 so the blocks form a base for the rails. The rails are retained in position by key elements 33 and 35. In the preferred embodiment, the rails 36 are made of a high temperature, slag resistant material which retains structural integrity at furnace operating temperatures and therefore does not require cooling.

A refractory plate 38 located at the entrance end of each furnace chamber 32 incorporates a central opening 40 for admitting stock 28 into the furnace chamber 32 from the adjacent transitional section 14 or 24. The opening 40 is large enough to admit stock and to simultaneously permit exhaust gases to be discharged from the chamber 32 in an annular gap surrounding the stock. The plate 38 may be formed of a refractory material which is identical or similar to that from which the refractory liner 34 is formed. The exit end of each chamber 32 incorporates an annular flame seal 46, having a centrally located opening 48 in line with the longitudinal axis of the furnace chamber 32. Consistent with the sealing function of the member 46, the opening 48 is only slightly larger than the stock to permit passage of the stock but to provide a tolerance close enough to eliminate or minimize the passage of combustion gases therethrough with the stock. The annular seal 46 may also be formed from high temperature, slag resistant material.

Figure 3:
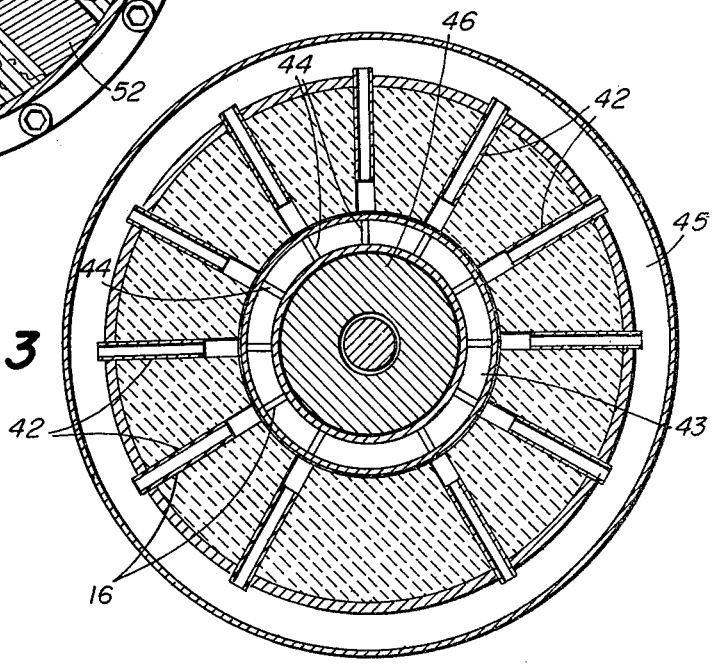
FIG. 3 is a sectional view of the device of FIG. 1, taken along the lines 3—3.

As shown in FIG. 3, the burner means 16 surrounds the annular seal 46. It comprises a series of gas jets 42 at uniform angular intervals around the seal 46 which are supplied with a gas (or, optionally, a gas-air mixture) from a manifold 45. The burner also comprises an air distributor 43 including a series of air jets 44 circumscribing the seal 46, each jet 44 being paired with a jet 42. The gas jets 42 are directed radially inward toward the central path defined by the skid rails 36. The air jets 44 are oriented to direct air along the central path, perpendicularly to the direction of the discharge issuing from the jets 42. The jets 42 and 44 are arranged so that each stream from a jet 42 intersects a stream from a jet 44.

In operation, the air distributor 43 receives combustion air from the forced air supply 47 and distributes it evenly to each of the air jets 44 surrounding the annular seal 46. Simultaneously, gas from the manifold 46 is distributed to each of the gas jets 42. Streams containing gas and air issue from the jets 42 and 44 and intersect to produce an effective mixing action. This yields a uniform fuel-air mixture in a ring around the central path defined by the rails 36 and thereby, upon ignition, yields a uniform flame ring around the central path. The ring of fuel-air mixture is established closely adjacent the annular seal 46 and, correspondingly, the flame ring therefrom is generated at the seal 46. Thereafter flame and combustion products travel along the chamber 32. The air streams from the jets 44, together with the overall combustion chamber geometry, produce flame and combustion products which travel approximately linearly from the exit end of the combustion chamber toward the entrance end of the combustion chamber, along the central path, in the direction opposite to that of the stock travel. Heat is transferred from the flame directly to the stock 28 and also to the liner 34. In the preferred embodiment, the flame heats the liner 34 to radiance so that the stock 28 receives heat energy by radiation from the liner. Since the heat input to the liner is directly from the uniform flame ring surrounding the stock path, it is heated in a radially uniform manner. In turn, there is a radially uninform heat input to the stock from the flame and a radially uniform heat emission to stock from the liner 34. The linear pattern of travel for flame and combustion products from the uniform ring of fuel-air mixture tends to maximize uniform heat transfer to the stock 28 and the liner 34. Further, the linear pattern of travel does not suffer interference from the rails 36 which establish the central path for the stock.

In a preferred embodiment, the gas issuing from the jets 42 is premixed with combustion air for efficiency. Combustion efficiency is maximized by premixing between 14 and 35% of the combustion air with the gaseous fuel. If circumstances require, a portion of the gaseous fuel may be premixed with the combustion air.

A short intense flame is preferred and, because of the burner configuration described above, this flame configuration can be achieved while minimizing combustion noise. Combustion gases pass along the furnace chamber 32, through the opening 40 of the refractory plate 38, through the stock delivery channel 18 and out through the flue means 20.

It will be appreciated that narrow annular slits could replace the series of jets 42 and 44. Also, fuel could be supplied by jets 44 and air by jets 42; however, depending on the fuel-air ratio, a less forceful linear path for flame and combustion products could result.

From FIG. 1, it will be appreciated that the modules 12 may be cascaded with each other. In this event, the inlet to the cascaded assembly is provided with a transitional means 24, the outlet end is provided with a transitional means 22 and a transitional means 14 is installed between each of the intervening modules 12.

Figure 4:
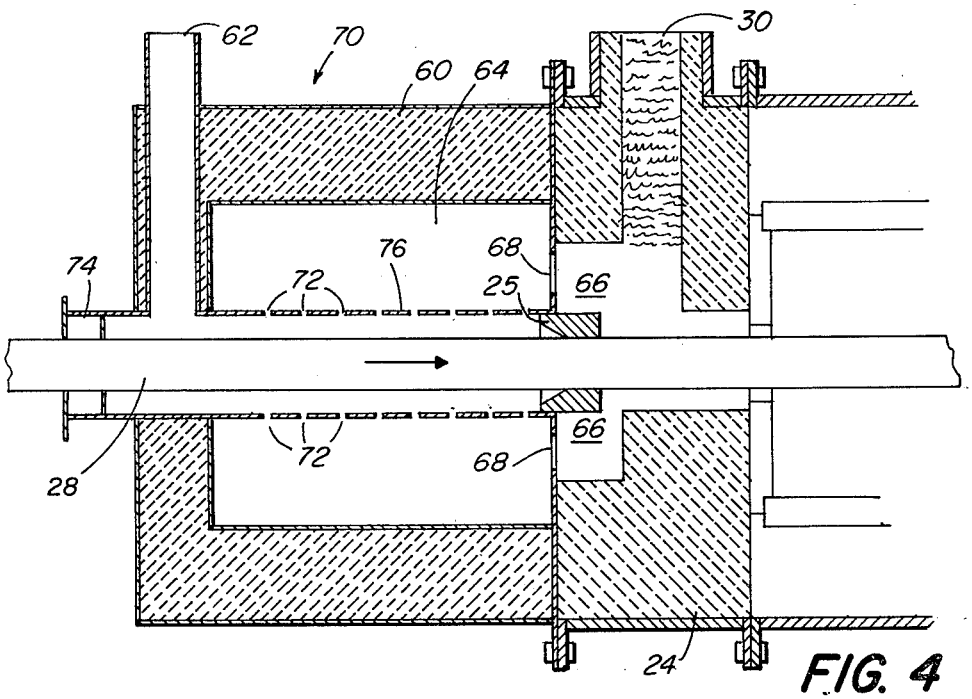
FIG. 4 is a sectional view of a preheater which may be connected to the device of FIG. 1 at the charging end thereof.

Optionally, a preheater 70 may be mounted in advance of the transitional means 24, as illustrated in FIG. 4. An insulated housing 70 surrounds the path of travel for the stock 28 and is provided with an exhaust stack 62 in fluid communication with a chamber 64. The transitional means 24 is modified to direct products of combustion into the chamber 64 rather than ejecting them through the flue 30. As illustrated, the flue 30 is blocked and an enlarged chamber 66 is formed within the body of the transitional means 24 around the flame sealing annulus 25. Openings 68 between the chambers 66 and 64 admit products of combustion through the chamber 64 where they pass through a baffle 70. The jets impinge upon the surface of the stock, transfer heat and exit through the exhaust stack 62. Means 74 at the forward end of the preheater 70 blocks products of combustion to prevent passage thereof from the preheater along the path of travel for the stock.

The furnace herein described, when operating with the inner surface heated to radiance, operates effectively with temperatures up to 2800° F. Further, the liner 34 does not reradiate heat effectively at temperatures below 1400° F. Therefore, the best operating temperature range of the furnace is 1400° F. to 2800° F. Stock traveling therethrough may be heated to corresponding temperatures between 1200° F. and 2400° F. considering preferred limits on the number of furnace modules in series and the speed of stock travel. When modules 12 are cascaded, particularly efficient operation can be achieved by operating each module so that the temperature difference between the radiating surface 34 and the stock 28 to which it radiates is minimal. For example, it is desired to heat a series of metal billets to 2400° F., a series of modules 12 can be assembled where the module from which the stock departs the series is operated at 2800° F. with other modules in the series each operating at a higher temperature than its preceding module. In this manner, the billets are heated in stages so that the temperature difference in any one stage is reduced, the extent of the reduction being a function of the number of stages used.

As various changes could be made in the above apparatus without departing from the scope of the invention, it should be understood that all matter contained in the above description or shown in the accompanying drawings shall be interrupted as illustrative and not in a limiting sense.

We claim:

1. A furnace comprising:

(a) elongated furnace chamber means defining a central workpiece path therethrough and an inner surface surrounding said path;

(b) first means surrounding said path at one end of said chamber means for directing into said chamber means one component for a combustible mixture as a stream substantially parallel to and surrounding said path; and (c) a second means surrounding said path at said one end of said chamber means for directing radially into said chamber means another component for a combustible mixture as a stream surrounding said path which flows substantially normal to said path, said first and second means being arranged for directing said streams into intersection with each other for producing a uniform combustible mixture in a ring around said path, whereby, upon combustion a uniform flame ring surrounds said path for heating workpieces thereon and for heating said inner surface.

2. A furnace according to claim 1 wherein said inner surface comprises a heat reradiative surface.

3. A furnace according to claim 1 wherein said first and second means each forms a series of jets at uniform angular intervals around said workpiece path, each jet of said first means being paired with a jet of said second means.

4. A furnace according to claim 3 further comprising rail means extending from said inner surface and forming supporting surface means along substantially the entire length of said chamber means, centrally thereof, to thereby define said workpiece path.

5. A furnace of claim 4 wherein said rail means comprises a pair of continuous, substantially solid plates extending from the inner surface of said chamber means to the central part of said chamber means, at an acute angle to each other, and defining along said workpiece path substantially straight supporting surfaces.

6. A furnace according to claim 5 further comprising:

(a) housing means surrounding and spaced from said chamber means; and (b) base means extending from said housing means to said chamber means for structurally supporting said chamber means and said solid plates.

7. A furnace according to claim 6 wherein said base means comprises a pair of supports along said chamber means opposite each solid plate.

8. A furnace according to claim 1 further comprising:

(a) entrance end closure means having an entrance port therein for admitting workpieces from outside said chamber means to said workpiece path during operation of said furnace; and (b) exit end closure means having an exit port therein for permitting discharge of workpieces from said workpiece path during operation of said furnace, said workpiece path extending from said entrance port to said exit port.

9. A furnace system comprising:

(a) a plurality of continuous furnace units for heating a continuous stream of stock, each furnace unit comprising; refractory material forming an interior reradiative surface surrounding a central path through said unit, end openings aligned with said central path for permitting passage of said continuous stream of stock through said unit, and rail means for supporting the stock along said central path;

(b) a separate burner means associated with each of said continuous furnace units, each of said burner means having a first feed means for directing one component of a combustible mixture as a predetermined number of gaseous jets in a generally radial direction toward said central path from a locus of points substantially surrounding the end opening of the associated furnace unit through which stock exists said unit, and a second feed means for directing another component of a combustible mixture as gaseous jets into the associated furnace unit in a direction substantially parallel to said central path, the jets from said second means corresponding in number to the number of jets from said first means, said first and second feed means directing said jets into intersection with each other for producing a uniform combustible mixture in a ring around said path; and (c) between each pair of adjacent units, a transitional means interconnecting the exit end of one unit to the entrance end of another unit with the central paths of said units being in substantial alignment, said transitional means having a channel for admitting stock from the central path of one unit to the central path of the other unit.

10. The furnace system of claim 9, further comprising flue means in each said transitional means communicating with said channel for exhausting combustion gases passing into said channel from the entrance end of said other unit.

11. A furnace comprising:

(a) an elongated furnace chamber having means defining a central workpiece path extending therethrough and means forming an inner surface within said furnace chamber suroounding said path;

(b) first means surrounding said path at one end of said furnace chamber for directing into said furnace chamber one component for a combustible mixture as a stream directed along and surrounding said path; and (c) a second means surrounding said path at said one end of said furnace chamber for directing into said furnace chamber another component for a combustible mixture as a stream surrounding said path which flows inward toward said path, said first and second means being arranged for directing said streams into intersection with each other for producing a combustible mixture in a ring around said path, whereby, upon combustion a flame ring surrounds said path for heating workpieces thereon and for heating said inner surface.

12. A furnace according to claim 11, wherein said first and second means each forms a series of jets at uniform angular intervals around said workpiece path, each jet of said first means being paired with a jet of said second means.

13. A furnace according to claim 11 wherein said inner surface comprises a heat reradiative surface.

* * * * *